United States Patent [19]

Tucsok et al.

[11] 4,046,325

[45] Sept. 6, 1977

[54] APPARATUS FOR CRUSHING ROCK, STONE AND LIKE MATERIAL

[76] Inventors: Steve Tucsok, 104-43 Suncrest Dr., Delta, British Columbia; Elemer Fogarassy, 6519 Markay Avenue, South Barnaby, British Columbia, both of Canada

[21] Appl. No.: 691,642

[22] Filed: June 1, 1976

Related U.S. Application Data

[63] Continuation of Ser. No. 594,378, July 9, 1975, abandoned.

[51] Int. Cl.[2] ..... B02C 13/09

[52] U.S. Cl. ..... 241/73; 242/76; 241/154; 241/187; 241/191; 241/195

[58] Field of Search ..... 241/73, 76, 78, 80, 241/101.7, 154, 157, 158, 159, 187, 191, 195, 213

[56] References Cited

U.S. PATENT DOCUMENTS

| | | | |
|---|---|---|---|
| 2,585,943 | 2/1952 | Kessler | 241/191 |
| 2,646,224 | 7/1953 | Chrystal | 241/191 |
| 2,775,174 | 12/1956 | Patrick | 241/76 |
| 2,977,057 | 3/1961 | Beyhl | 241/213 |
| 3,847,362 | 11/1974 | Lowe et al. | 241/195 |
| 3,874,603 | 4/1975 | Lowe et al. | 241/191 |
| 3,878,995 | 4/1975 | Nash | 241/187 |

*Primary Examiner*—Granville Y. Custer, Jr.

[57] ABSTRACT

Apparatus for crushing rock, stone and like material is described. The apparatus includes primary and secondary crushing chambers containing respectively a rotary impactor and a hammer mill. The apparatus can operate either in a wet mode or in a dry mode. In the former case material is processed successively in the two crushing chambers and discharged from the apparatus. In the wet mode, material is first processed in the primary crushing chamber and then discharged from said chamber for processing externally of the apparatus. At least some of the material is then returned to the secondary crushing chamber for further processing and discharge.

17 Claims, 11 Drawing Figures

APPARATUS FOR CRUSHING ROCK, STONE AND LIKE MATERIAL

This is a continuation of application Ser. No. 594,378, filed July 9, 1975 now abandoned.

This invention relates to apparatus for crushing rock, stone and like material.

In the recovery and processing of minerals, a range of different types of crushing apparatus is normally required for use at different stages in the overall processing operation and in order to cater for different input materials. Examples of such apparatus are jaw crushers, cone crushers, rod mills and ball mills. As a result of this requirement, significant operating costs and capital costs are incurred. Further, such apparatus are not economically transportable to a fresh operating site. New equipment must either be provided at a new site, or the material to be processed must be transported to existing crushing apparatus.

All of these factors have resulted in a situation in which mineral recovery and processing is only economic if it can be carried out on a relatively large scale. Even then, extensive preliminary investigations are required in order to assess whether it may be possible to derive an adequate return from the substantial capital investment required.

An object of the present invention is to provide an improved crushing apparatus primarily for use in the processing and recovery of minerals.

According to the invention, the apparatus is operable selectively in a mode for crushing dry material, or in a mode for crushing wet material. The apparatus includes a casing which defines:

a. a primary crushing chamber having an inlet to receive material to be crushed, and first and second outlets. The first outlet is adapted to receive first screening means for controlling the size of material delivered through said first outlet when the apparatus is operating in the dry mode. The first outlet is closed when the apparatus is operating in the wet mode. The second outlet opens to the exterior of the casing and is adapted to be closed when the apparatus is operating in the dry mode;

b. a secondary crushing chamber having an inlet and first and second outlets. The said second outlet opens the exterior of the casing and is adapted to be closed when the apparatus is operating in the dry mode; and, c. a passageway disposed above the secondary crushing chamber. The passageway communicates with the first outlet of the primary crushing chamber and with the inlet and first outlet of the secondary crushing chamber. The passageway defines an opening to the exterior of the casing and is adapted to receive, adjacent said opening, second screening means for controlling the size of material delivered outwardly through said opening when the apparatus is operating in the dry mode.

The apparatus also includes a rotary impactor mounted for rotation in the primary crushing chamber. Means are provided for adjusting the position of the impactor in the primary crushing chamber between a first position in the dry mode of operation of the apparatus, and a second position in the wet mode. The impactor is arranged, when in said first position, to generate air pressure in the primary crushing chamber tending to assist delivery of crushed material from the first outlet of the chamber and along said passageway. A rotary hammer mill is mounted for rotation in the secondary crushing chamber.

When the apparatus is operating in the dry mode, material processed in the primary crushing chamber is delivered from said first outlet into said passageway. Material of a size passed by said second screening means is discharged from the apparatus through said opening. The remaining material falls back into the secondary crushing chamber for secondary processing and subsequent return to the passageway through the first outlet of the secondary crushing chamber. In the wet mode of operation, material processed in the primary crushing chamber is delivered from said second outlet of the chamber for processing externally of the apparaus. At least some of this material is subsequently delivered into said opening in the passageway and passes to the secondary crushing chamber for processing and discharge from the second outlet of the chamber.

The expression "rotary impactor" used in this application denotes a device including a rotor and a plurality of fixed hammers coupled to the rotor for rotation therewith. The expression "hammer mill" is used to denote a similar structure in which the hammers are pivotally coupled to the rotor so as to be capable of swinging freely as the rotor turns in use.

Reference will now be made to the accompanying drawings which illustrate various embodiments of the invention by way of example. In the drawings.

Figure 1:
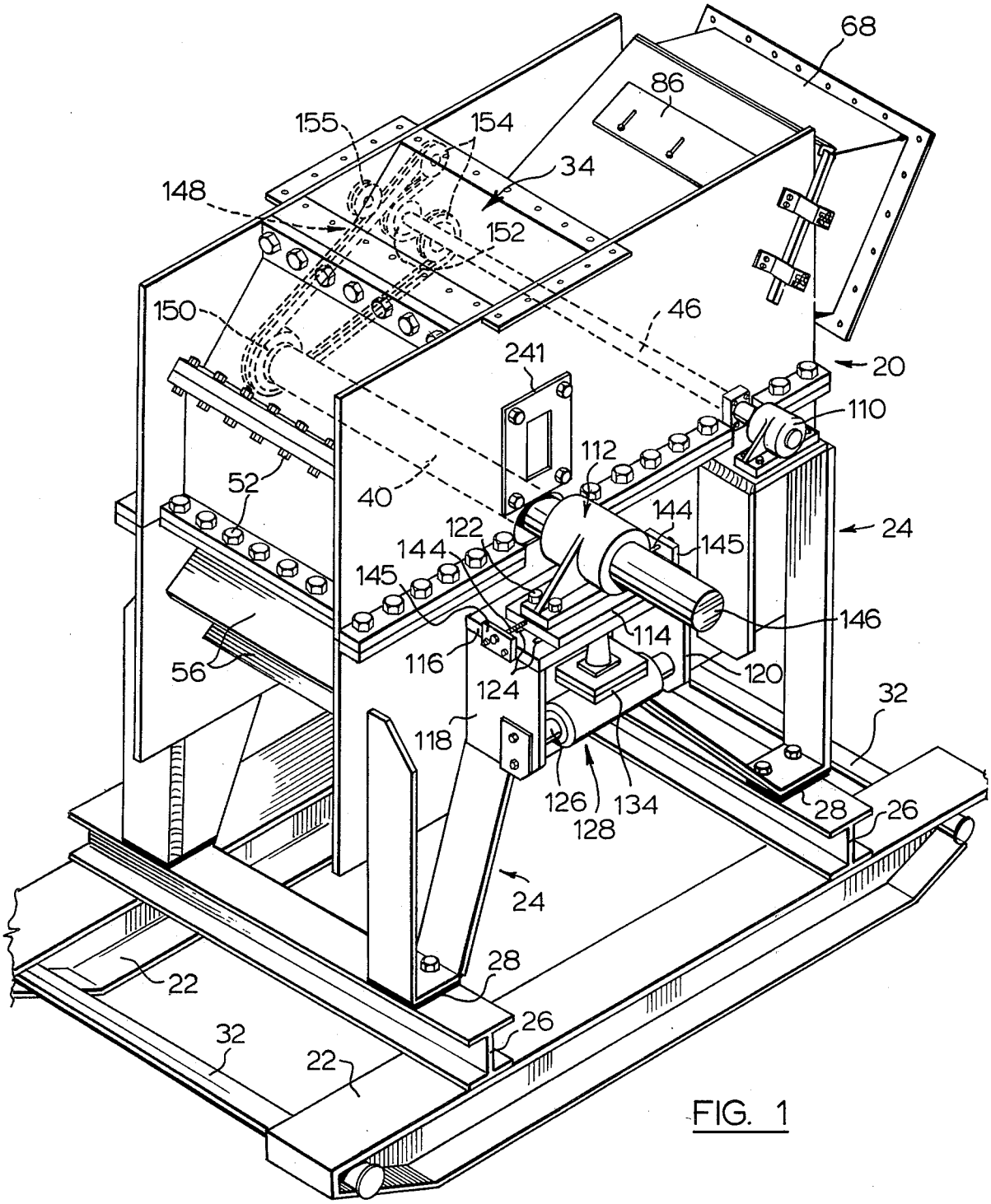
FIG. 1 is a perspective view from one end and one side of a rotary crushing apparatus (hereinafter called a crusher) for use in the processing and recovery of minerals.
Figure 2:
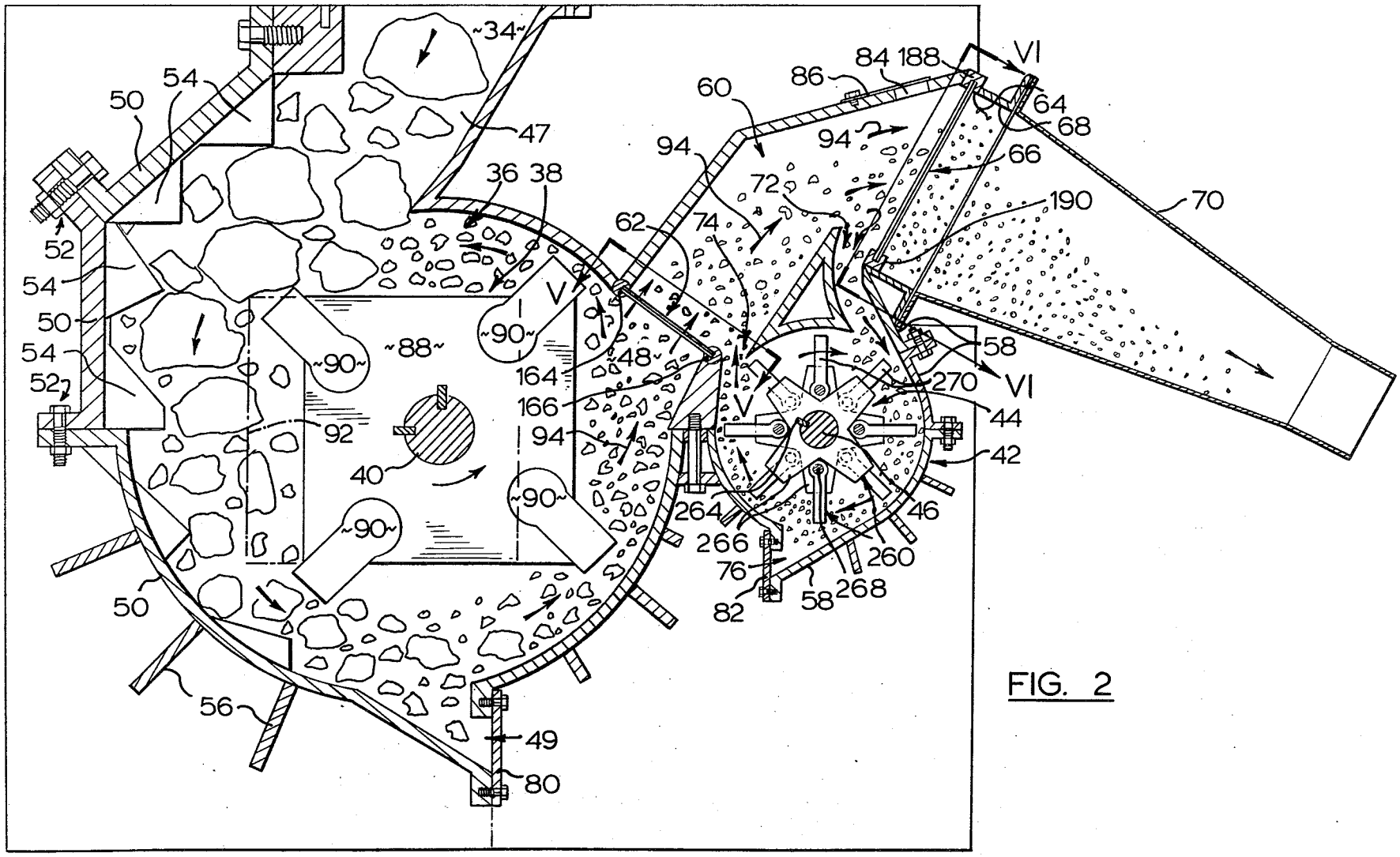
FIG. 2 is a longitudinal vertical sectional view of the crusher of FIG. 1, the crusher being shown in its dry mode of operation.
Figure 3:
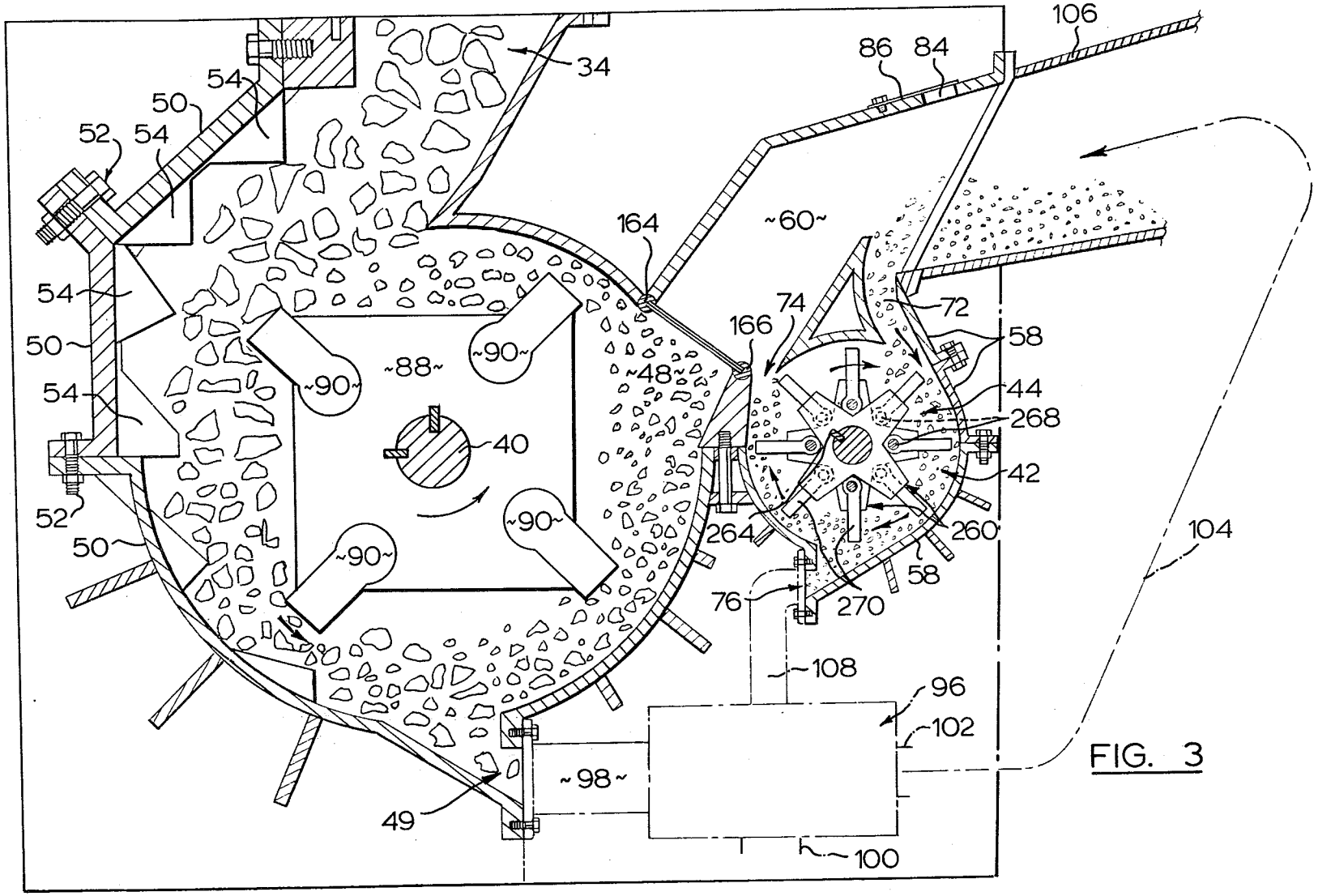
FIG. 3 is a view similar to FIG. 2 showing the crusher in its wet mode of operation.

Reference will first be made to FIGS. 1 to 3 in describing the general structure of the crusher. As indicated above, the crusher is shown ready for operation in different modes in FIGS. 2 and 3, although the structure is basically the same in both views. The crusher as shown in FIG. 2 is for use in crushing dry material in FIG. 2, whereas in FIG. 3 the crusher is shown for use with an input of wet material.

The crusher shown in the drawings is portable and is intended to be towed behind a towing vehicle such as a caterpillar tractor or pulled by a winch or the like, e.g. onto a low loader. The crusher includes a casing generally indicated at 20 supported on a pair of parallel skids 22 of I-shape in cross-section. Brackets generally denoted 24 are welded to the casing 20 and are supported at their lower ends on two tranverse I-beams 26. The I-beams in turn are supported at their ends on the skids 22. Rubber vibration isolating pads 28 are provided between the brackets 24 and the I-beams 26. At each end of the crusher, a tow bar 32 extends between the skids 22 and is disposed parallel to the I-beams 26. The tow bars 32 allow a towing vehicle, winch or the like to be coupled to the crusher when it is to be moved.

As can be seen in FIG. 1, the casing 20 of the crusher is provided at its top with a rectangular opening 34 to receive material to be crushed. Referring now to FIGS. 2 and 3, the opening 34 communicates with a primary crushing chamber 36 inside the casing 20. Chamber 36 contains a rotary impactor 38 having a horizontal drive shaft 40. Casing 20 also defines a secondary crushing chamber 42 which houses a rotary hammer mill 44 having a horizontal drive shaft 46 disposed parallel to the shaft 40 of the impactor. The shafts 40 and 46 are indicated in dotted lines in FIG. 1 and it will be noted that they are disposed in a common horizontal plane. Details of the impactor and hammer mill have not been shown in FIG. 1 in the interests of clarity of illustration.

Referring back to FIGS. 2 and 3, the opening 34 in the casing 20 of the crusher leads to a chute section 47 defined by the casing. Section 47 opens into the crushing chamber 36 and defines an inlet to said chamber. Chamber 36 also has first and second outlets 48, 49 respectively (see later) defined by the casing 20. It will be noted that the part of the casing 20 defining the outer wall of the chute 47 and of the crushing chamber 36 is made up of a number of casing sections 50 connected by nut and bolt couplings 52. Each of the sections 50 is provided with a number of inwardly directed generally triangular formations 54 which act as so called impactor breakers and against which rock is thrown by the rotary action of the impactor 38 when the crusher is in use. The top two casing sections 50 are removable by virtue of the nut and bolt couplings 52 to provide access to the interior of the crushing chamber 36 for maintenance purposes; for example to allow replacement of the sections themselves and/or the impactor breakers 54. The projections 56 on the lower section 50 represent supporting cross struts.

It will be noted that part of the casing defining the outer wall of the secondary crushing chamber 42 is formed by sections 58 which are similar to the sections 50 and which are also joined by nut and bolt couplings. The top two sections 58 are also removable for maintenance purposes.

The casing 20 of the crusher defines a passageway 60 above the secondary crushing chamber 42. The lower end of passageway 60 communicates with the first outlet 48 of the primary crushing chamber 36. In FIG. 2, a perforated screen assembly 62 (to be described) is provided in said outlet 48. In FIG. 3, the outlet is closed. At its upper end, passageway 60 terminates at an opening 64 in the casing. In FIG. 2, a screen assembly 66 (to be described) is located in opening 64. A flanged coupling piece 68 is attached to the casing 20 externally of screen assembly 66. A discharge chute 70 is removably fitted to the coupling piece 68 for the delivery of crushed material from the crusher.

The secondary crushing chamber 42 has an inlet 72 and a first outlet 74 both of which communicate with passageway 60 adjacent respectively opposite ends of the passageway. Chamber 42 also has a second outlet 76 similar to the second outlet 49 of the primary crushing chamber 36. In FIG. 2, these second outlets 49, 76 are closed by respective closure plates 80, 82 secured to casing 20 by bolts.

An air vent 84 is provided in the part of the casing which defines the passageway 60. An adjustable closure plate 86 is provided in association with the vent 84 whereby the size of the vent opening can be varied.

The impactor is in the form of a rotor of generally square shape in cross-section. The rotor includes a laminated core 88 mounted on the drive shaft 40 referred to above, and four hammers in the form of impactor bars 90 arranged generally at the four corners of the square cross-section of the rotor core. The impactor drive shaft 40 is adjustable longitudinally of the crusher to move the rotor from the full line position in which it is shown in FIG. 2, leftwards to the position indicated in chain line at 92. The rotor is shown in this left hand position in FIG. 3. It will be seen that, in the right hand position of FIG. 2, the impactor rotor is disposed relatively close to the portion of the casing 20 defining the right hand side of the crushing chamber 36 considered as seen in FIGS. 2 and 3. The parts of the casing defining the end walls of the chamber 36 are also disposed relatively close to the ends of the rotor. As the rotor rotates (in the direction of the arrow) in the FIG. 2 (dry) crushing mode an air pressure is generated inside the crushing chamber. This results in an air flow as indicated by the arrows 94 in FIG. 2 through the screen assembly 62, along passageway 60, through screen assembly 66 and out through the chute 70. The air pressure may be varied by adjusting the position of the air vent closure plate 86 in passageway 60.

Considering the dry mode of operation of the crusher (FIG. 2), as the impactor rotor rotates in use, material delivered to the crusher through opening 34 is hit by the rotating impactor bars 90 causing some breakage of material. The action of the impactor bars also throws the material against the impactor breakers 54 on the inner surface of the casing, causing further breakage. The impactor breakers are specially angled as shown for optimum effect. Large particles resulting from primary impacts between the rock and the impactor brackets bounce back into the paths of the impactor bars 90 and are subject to secondary impacts. Similar impacts take place repeatedly as the material moves progressively through the primary crushing chamber. Smaller particles produced by these impacts are entrained by the air flow generated by the impactor rotor. When the material reaches the screen assembly 62, particles smaller than the mesh size of the screens will travel through the screen assembly with the air stream represented by arrows 94. Larger particles will continue to circulate in the crushing chamber 36 until reduced to a size to allow them to pass through the screen assembly 62.

Particles passing through the screen assembly 62 travel along passageway 60 to screen assembly 66 in the air stream produced by the impactor rotor. The mesh size of the screen assembly 66 is smaller than the mesh size of assembly 62. Particles of a size to pass through assembly 66 will pass into the chute 70, whereas larger particles will be held back by the screen assembly. It will be noted that the screen assembly 66 is angled forwardly at its upper end. Particles held back by the assembly will therefore tend to fall down the inner face of the screen and will pass into the inlet opening 72 of the secondary crushing chamber 42. These particles will be further reduced in size by the action of the hammer mill 44 (to be described). Resulting particles will be discharged upwardly from chamber 42 to rejoin the air stream in passageway 60. In this connection, it will be appreciated that the air stream in passageway 60 will tend to produce a low pressure area in the region of outlet 74, which will tend to assist movement of particles from chamber 42 into the passageway 60. If the particles rejoining the air flow in passageway 60 are of suitable size, they will pass through the screen assembly 66 and out through the chute 70. Chute 70 acts as an automatic "upgrader". The material discharged from chute 70 is automatically upgraded; that is, the material settles onto the ground or other surface adjacent the chute in an elongate pile in which the heavier (coarser) particles are disposed nearest the chute and the lighter (finer) particles are disposed furthest away from the chute.

By way of illustration of the size reduction which may be achieved in chamber 36, the core 88 of the impactor rotor may have sides of approximately 24 inches in length (considered in cross-section) and the opening 34 in the crusher casing may be approximately 14 by 35 inches. A crusher of this size is capable of accepting rock up to 12 inches in diameter. If the impactor rotor is rotating at approximately 1200 RPM, the rock may be reduced to a size of ⅜ of an inch or less in the primary crushing chamber 36.

FIG. 3 shows the crusher of FIGS. 1 and 2 in a mode for operation with an input of wet material. In this case, the crusher is used in association with a conventional classifier. The classifier is an entirely standard piece of equipment and is therefore shown only in chain line at 96. Typically, the classifier will be a "Denver Jig" for wet material and, for dry material, a "Universal Classifier", both sold by Denver Equipment Company of Denver, Colo., U.S.A. The classifier 96 is coupled to the second outlets 49 and 76 of the crushing chambers 36 and 42 respectively. The closure plates 80 and 82 are removed and replaced by flanged couplings connected to the classifier and the screen assemblies 62 and 66 are removed. Assembly 62 is replaced by a solid closure panel. The classifier includes a first inlet 98 connected to the primary crushing chamber 36. The classifier is adapted to separate out material below a certain predetermined size. This material is discharged from a main classifier outlet 100. Material above the said certain size is discharged through a different outlet 102 to a conventional belt conveyor indicated by chain line 104, by which the material is returned to the crusher. For this purpose, the coupling piece 68 and chute 70 shown in FIG. 2 are replaced by an inlet chute 106 into which the material is delivered from the belt conveyor 104.

Material delivered into the chute 106 by conveyor 104 travels down the chute under gravity and through the opening 72 into the secondary crushing chamber 42. This material is reduced in size by the hammer mill and delivered from the second outlet 76 of the secondary crushing chamber to an inlet 108 of the classifier. Material below the said predetermined size is discharged through the classifier outlet 100. Larger material passes through outlet 102 and is again returned to the hammer mill. The crusher and classifier operate continuously in this fashion, producing a continuous output of material of a size below said predetermined size.

Air pressure plays no part in operation of the crusher in the wet mode. Further, it is desirable to maintain a reasonably substantial clearance between the rotating impactor bars and the casing of the crushing chamber 36 in order to avoid an excess build up of material between the impactor rotor and the casing. For these reasons, the rotor is located in the left hand position, generally centrally in the crushing chamber 36 during operation in the wet mode.

Having generally described the two modes of operation of the crusher, reference will now be made to the mechanism for adjusting the position of the impactor rotor and to the drive for the impactor and hammer mill.

FIG. 1 shows the drive shafts 40 and 46 of the impactor and hammer mill respectively. Both ends of each shaft project through the casing 20 of the crusher. At each end, shaft 46 is rotatably supported in a bearing 110 supported on one of the brackets 24 on the casing 20. Each end of shaft 40 is similarly rotatably mounted in a bearing 112 disposed externally of the casing 20. Each bearing 112 includes a base plate 114 supported on a horizontal part 116 of another of said brackets 24. The relevant bracket includes, in addition to plate 116, vertical side plates 118 and 120 located below and supporting opposite ends of plate 116. The base plate 114 of bearing 112 is coupled with plate 116 by bolts 122 passing through slots 124 in plate 116. Nuts (not visible) are provided on the bolts 122 below plate 116. The slots 124 extend longitudinally of the crusher so that the bearing 112 can be adjusted in said longitudinal direction after slackening the bolts 122. A similar arrangement is provided for the bearing 112 at the opposite side of the crusher.

Figure 4:
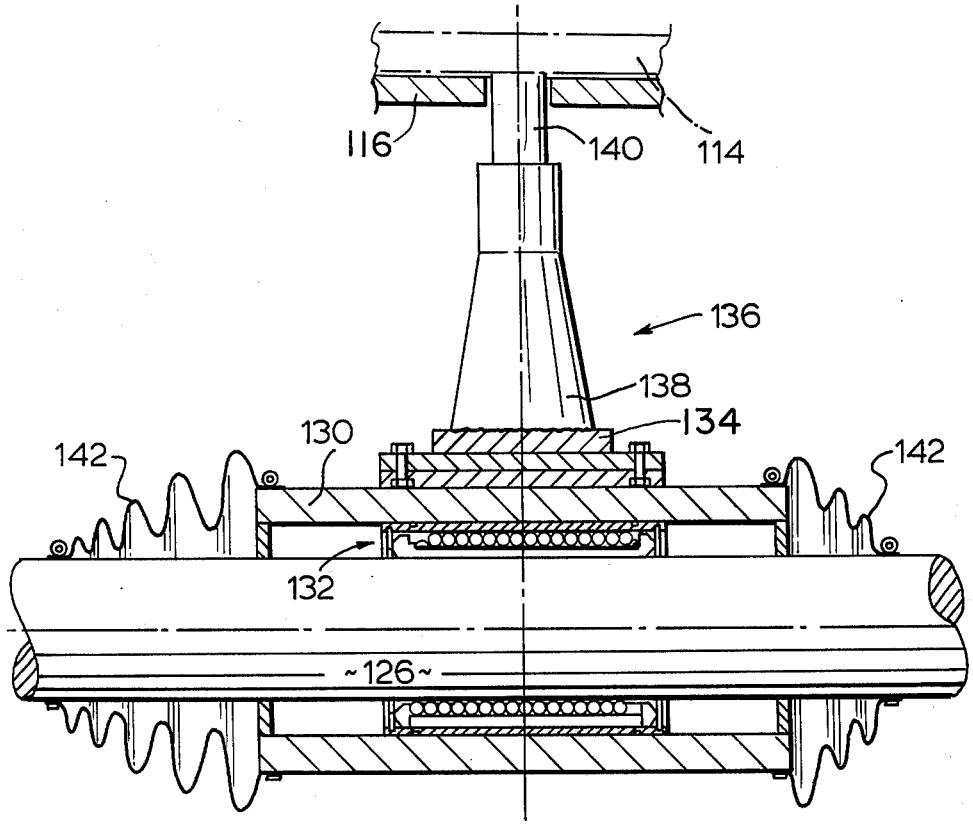
FIG. 4 is a vertical sectional view through part of the crusher shown in FIG. 1.

A circular section shaft 126 extends between the vertical plates 118 and 120 below the bearing 112 and supports a device generally denoted 128 for adjusting the position of the bearing 112 longitudinally of the crusher housing. It will be appreciated that the position of the impactor can be adjusted between the two positions referred to above, by adjusting both bearings 112. A device similar to device 128 is provided at the opposite side of the crusher although this device is not visible in FIG. 1. FIG. 4 shows the adjusting device 128 in detail and will now be described. The device includes a sleeve 130 which extends around shaft 126 and which is fitted with a bearing assembly 132 designed to permit sliding movement of the sleeve 130 along shaft 126. Sleeve 130 is provided with an enlargement 134 (FIG. 1) which defines a flat upper surface providing a support for a hydraulic piston and cylinder unit generally denoted 136. The cylinder 138 of the unit is mounted on the support so that the unit is generally vertical. The piston 140 of the unit 136 projects upwardly from the cylinder and is coupled at its upper end to the base plate 114 of the bearing 112. Plate 114 is indicated in chain line in FIG. 4. If the bolts 122 securing the bearing 112 to the plate 116 are slackened and the piston 140 of the piston and cylinder unit 136 is extended, the weight acting on the bearing 112 is carried on the shaft 126 by way of the bearing 132. The sleeve 130 can now be moved longitudinally with respect to shaft 126 to adjust the position of the bearing 112 as allowed by the slots 124 receiving the bolts 122. Rubber sealing boots 142 extend between opposite ends of the sleeve 130 and the shaft 126 to guard against the ingress of foreign material.

Sleeve 130 is moved longitudinally of shaft 126 by means of adjusting bolts 144 (FIG. 1). Each bolt passes through an opening in a vertical plate 145 attached to plate 116, and, at its outer end, engages the base plate 114 of bearing 112. Accordingly, simultaneous rotation of the bolts 144 displaces bearing 112 longitudinally with respect to the shaft 126. When the bearing reaches its adjusted position, the piston 140 of piston and cylinder unit 136 is retracted and the bolts 122 are tightened to lock the base plate 114 of the bearing 112 to its support plate 116.

As indicated above, this adjustment mechanism is duplicated at the side of the casing 20 opposite that which is visible in FIG. 1 so that both ends of the shaft 40 can be adjusted.

The impactor is driven by an electric motor (not shown) coupled to the outer end 146 of the impactor drive shaft 40 (FIG. 1). For this purpose, one or more pulleys (not shown) will normally be fitted to the said end of the shaft. The motor may be mounted on separate support structure (e.g. including skids) coupled to the crusher by bracing members. The hammer mill drive shaft 46 is driven from the impactor drive shaft 40 by way of a multiple drive belts indicated at 148 in FIG. 1. Belts 148 pass around pulleys 150 on the end of shaft 40 remote from end 146. A set of similar but smaller pulleys 152 is provided on the corresponding outer end of the hammer mill drive shaft 46. Two sets of idler pulleys 154 are also provided and are located on respectively opposite sides of pulleys 152. As can be seen, the belts 148 are reversed in passing around the pulleys 152 so that the shafts 40 and 46 rotate in opposite directions. An adjustable idler 155 is provided on the crusher casing for the purpose of adjusting the tension in the belts when the impactor is moved between its two operating positions in use.

As has been previously mentioned, the impactor rotates at a speed of the order to 1200 RPM. The pulleys 150 and 152 are dimensioned so that the hammer mill rotates at approximately 2400 RPM.

Figure 6:
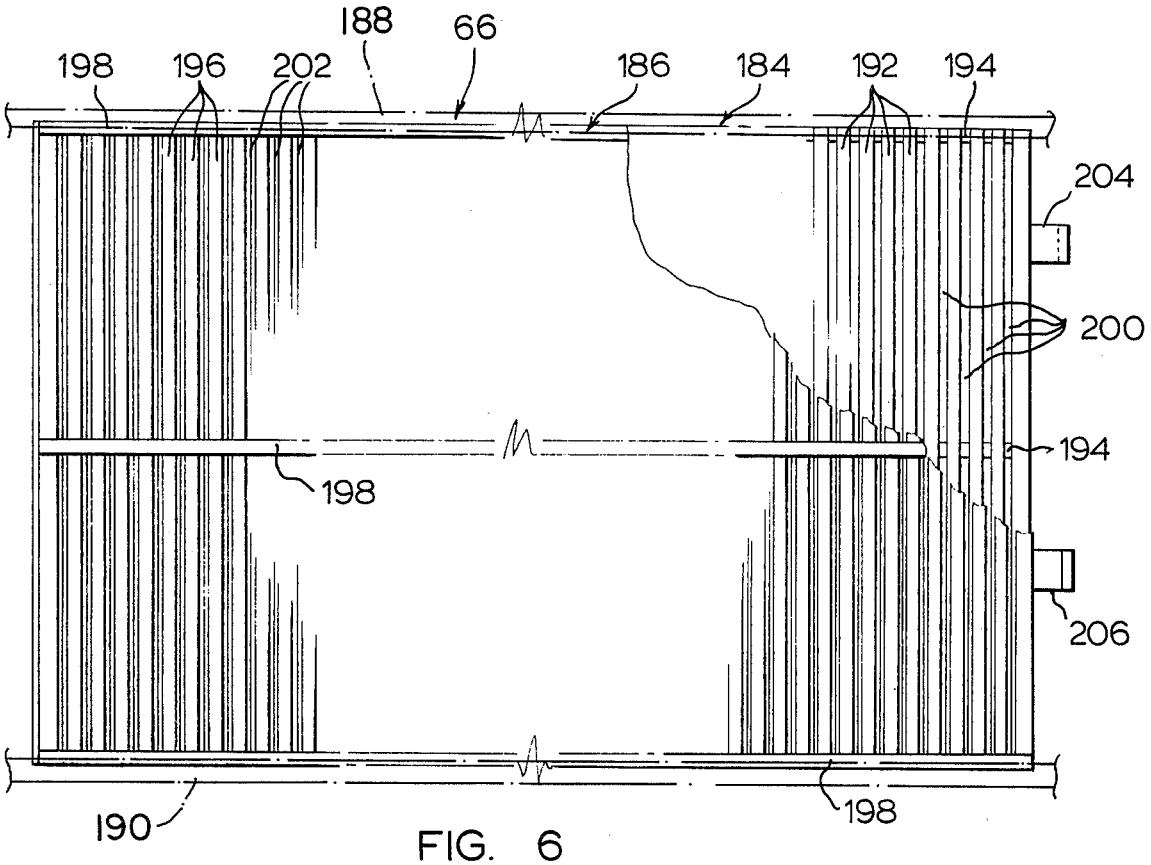
FIG. 6 is a sectional view on line VI—VI of FIG. 2.
Figure 5:
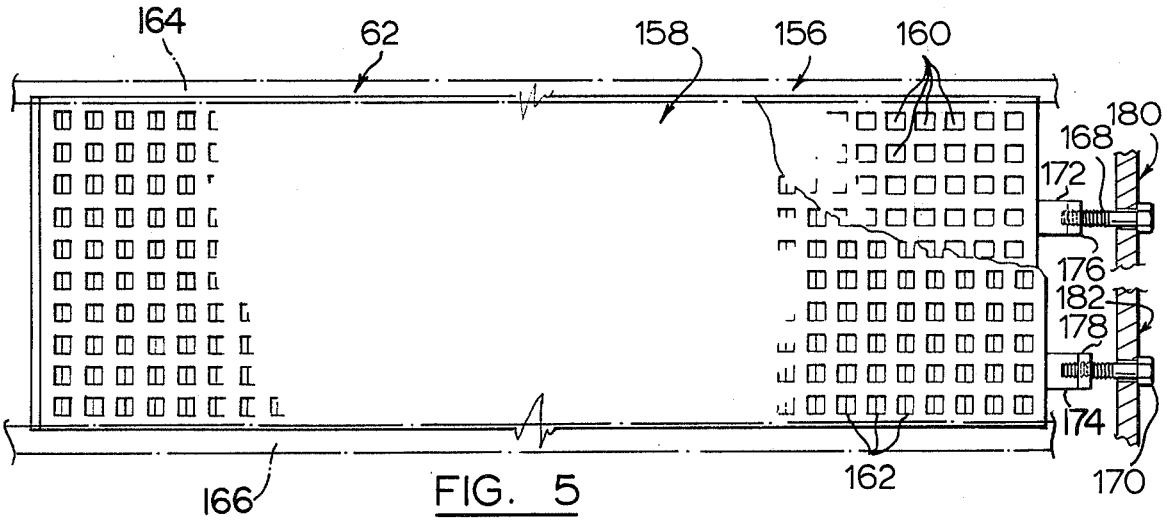
FIG. 5 is a sectional view on line V—V of FIG. 2.

FIGS. 5 and 6 show the screen assemblies 62 and 66 respectively of FIG. 2. Referring first to FIG. 5 the screen assembly 62 comprises two screens formed by perforated plates 156, 158 arranged in sliding surface contact. As can be seen, the perforations in the respective plates are formed by rectangular apertures 160, 162 respectively. The upper and lower longitudinal margins of the plates 156, 158 are received in respective channel members 164, 166 mounted in the casing of the crusher (see FIG. 2). Accordingly, the plates 156, 158 are longitudinally slidable relative to one another to vary the degree of coincidence between the apertures 160 and 162 of the respective plates. In this way, the size of the openings through the screen assembly is varied.

Longitudinal adjustment of the screens 156, 158 with respect to one another is effected by adjusting screws 168, 170 engaging lugs 172, 174 on the respective plates 156, 158. Corresponding ends of the respective plates are each provided with two similar lugs 172, 174 although only one lug on each plate is visible in FIG. 5. Each lug includes a laterally deflected portion 176, 178 formed with a screw threaded aperture to receive the relevant adjusting screw 168 or 170. Each screw also passes through a plain aperture in an appropriate part of the casing of the crusher (indicated in 180, 182 in FIG. 5) whereby the heads of the adjusting screws are exposed.

FIG. 6 shows the screen assembly 66. This assembly is basically very similar to the assembly 62 in that it comprises two screens 184, 186 slidably located in channel members 188, 190 in the casing of the crusher (see FIG. 2). It will be noted that the screens at 184, 186 are of somewhat greater height than the screens 156, 158 in view of the size of the opening in which they are fitted. Each screen 184, 186 is made up of a series of vertical slats extending between longitudinal members so as to define a plurality of narrow elongate apertures. The slats of screen 184 are denoted 192 and the associated longitudinal members are denoted 194. In the case of screen 186, the slats are indicated at 196 and the longitudinal members at 198. The apertures in screen 184 and denoted 200 and the apertures in screen 186 are denoted 202. Lugs similar to the lugs 172, 174 of FIG. 5 are provided on the screens 184, 186 and are denoted respectively 204, 206. Adjusting screws, (not shown) engage the lugs and can be turned to effect longitudinal movement of the screens 184, 184 to vary the degree of coincidence of the apertures 200, 202 in similar fashion to that of FIG. 5.

It will be appreciated from the description of FIGS. 5 and 6, that both screen assemblies 62, 66 can be adjusted to vary the size of material which will pass therethrough. The assemblies will be appropriately adjusted at the beginning of each crushing operation. Adjustment of screen 62 will ensure that only material of a suitable size will pass from the primary crushing chamber 36 to the secondary crushing chamber 42. Similarily, adjustment of screen 66 will control the size of particles issuing from the crusher. The screen assembly 62 and 66, are of course, used only when the crusher is operating in the dry mode as illustrated in FIG. 2. In the wet mode of FIG. 3, screen assembly 66 is removed entirely and assembly 62 is replaced by an imperforate screen.

Figure 8:
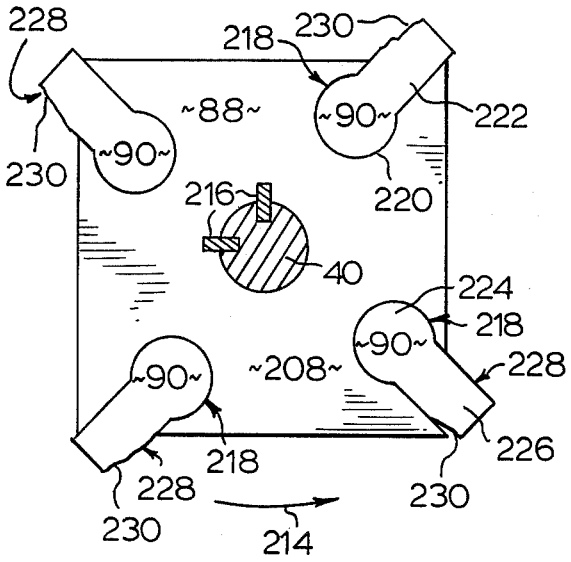
FIG. 8 is a vertical sectional view corresponding to FIG. 7.
Figure 7:
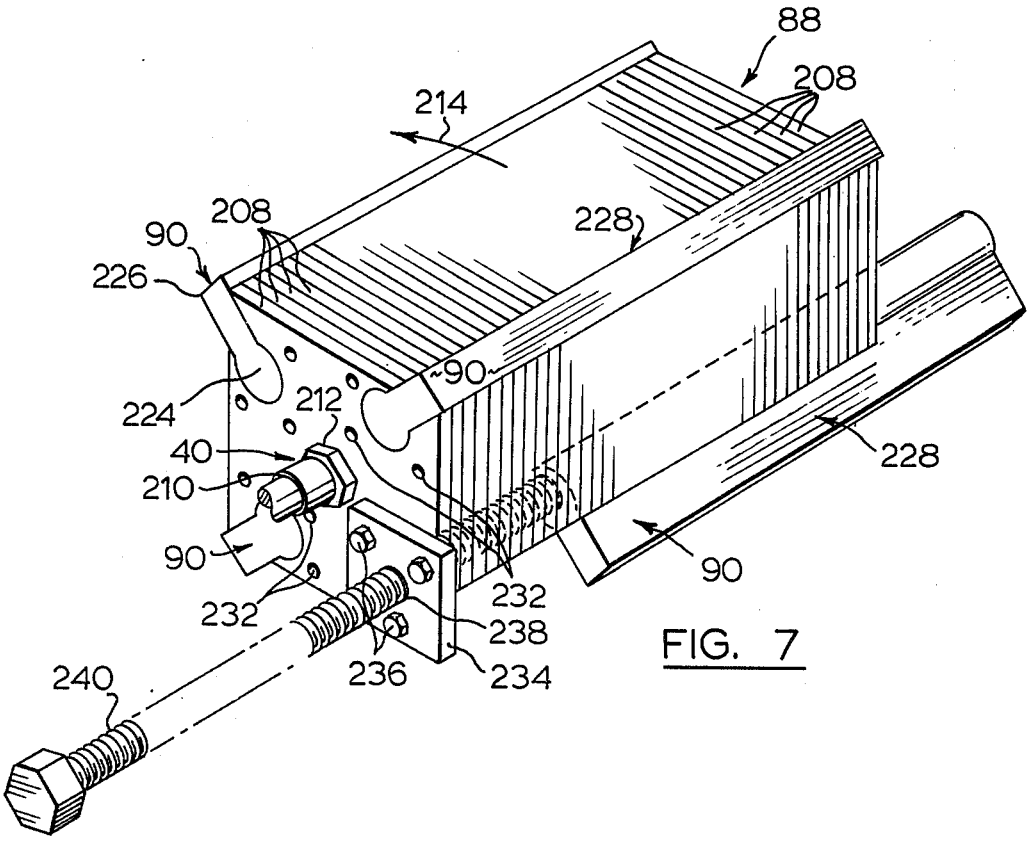
FIG. 7 is a perspective view of the impactor of the crusher of FIG. 1.

Reference will now be made to FIGS. 7 and 8 in describing the construction of the impactor rotor 38. As has already been mentioned, the rotor includes a core generally denoted 88 and four impactor bars 90. The core 88 is of laminated form and is made up of a series of generally square steel plates 208 fitted onto the drive shaft 40 of the impactor. The shaft is shouldered adjacent opposite ends of the assembly of plates 208, one of the shoulders being visible at 210 in FIG. 7. Just inwardly of each shoulder 210, the shaft 40 is formed with a screw thread (not visible) which receives a nut one of which is indicated at 212. The assembly of plates 208 is effectively clamped between the nuts. The thread which receives the nut 212 is a left hand thread and the thread at the opposite end of the assembly of plates 208 is a right hand thread. The direction of rotation of the impactor rotor in use is indicated by arrow 214.

FIG. 8 is a vertical sectional view through the assembly of plates 208. In the section between the screw threads, shaft 40 is provided with two longitudinally extending keys 216 which project mutually at right angles from the surface of the shaft. Each of the plates 208 is correspondingly notched adjacent its central aperture to receive the keys 216. Each of the plates 208 is formed adjacent each corner with a recess 218 shaped to receive one of the impactor bars 90. Each recess includes a circular portion 220 and a portion 222 having parallel sides. One of said sides intersects with the adjacent corner of the plate 208. It will be appreciated that, in the assembly of plates 208, the recesses 218 co-operate to define longitudinally extending slots in the rotor 88. These slots receive the impactor bars 90.

Each impactor bar 90 is of elongate form as can be seen from FIG. 7 and includes a portion 224 of circular shape in cross-section and a parallel sided portion 226. These portions define a cross-section complementary to the cross-section of said slots in the rotor core. The portion 226 of each impactor bar is of a length such that the bar projects from the relevant corner of the core 88 of the impactor rotor and presents an exposed, inclined impactor face 228 for action on material being processed in the crusher. The impactor bars 90 are solid and are cast in manganese.

It will be appreciated that, when the impactor is in use, the impactor face 228 of each bar 90 will be worn down by attrition as indicated at 230 on the bars 90 in FIG. 8. The bars are designed to be reversible when this wear reaches an unacceptable level. In FIG. 8, the bottom right hand bar 90 has been reversed so that the worn face 230 now becomes the trailing face and a fresh impactor face 228 is now available.

FIG. 7 shows how the impactor bars 90 are removed from and refitted into the core 88 of the impactor rotor. The plates 208 at opposite ends of the core 88 are each formed with a series of screw threaded holes 232 to receive bolts for securing plates over the ends of the impactor bars 90. One such plate is indicated at 234 in FIG. 7 and is retained by bolts inserted in the relevant ones of the holes 232. The heads of these bolts are visible 236. Plate 234 is formed with a central screw threaded aperture 238 to receive a large bolt 240. When this bolt is screwed into the aperture 238, its inner end engages one end of the circular section portion 224 of the relevant impactor bar 90. By rotating the bolt 240, the impactor bar can be pressed out of the core 88. Removable panels 241 (FIG. 1) are provided in the casing 20 of the crusher adjacent respectively opposite ends of the impactor rotor 38. These panels are removed to permit removal and replacement of the impactor bars. The bars are of a size which allows them to be manually lifted from the crusher after they have been pressed out of core 88. Replacement of a bar is effected by manually inserting one end of the bar into the relevant slot formed by the recesses 218 in the assembly of plates 208, and sliding the bar along the slot to its fitted position. Plates similar to plate 234 may then be fitted to opposite ends of the core to retain the impactor bars against longitudinal movement in use. However, under normal conditions, this would not be necessary since it is anticipated that longitudinal movement of the bars will probably not take place in normal use of the crusher.

Figure 8A:
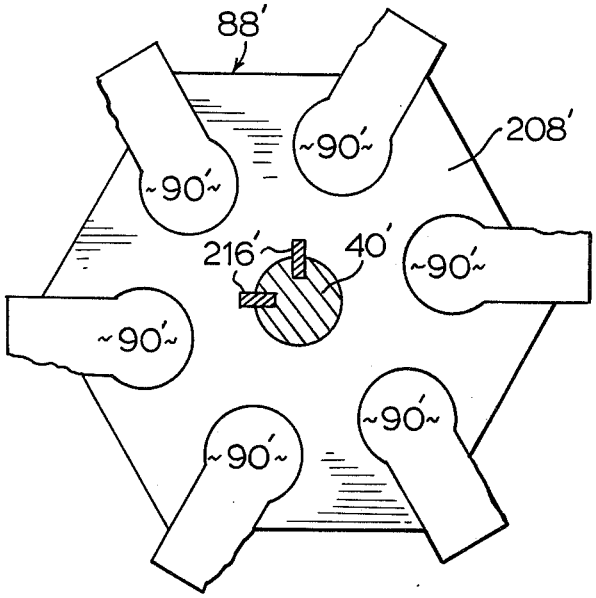
FIG. 8A is a view similar to FIG. 8 showing an alternative form of impactor.

FIG. 8A shows a modified impactor rotor in which primed reference numerals have been used to denote parts corresponding with FIGS. 7 and 8. In FIG. 8A the core 88' of the rotor is made up of an assembly of plates 208' of hexagonal shape formed adjacent each corner of the hexagon with a recess 218' of a shape similar to that of recess 218 in FIG. 8. Accordingly, six recesses 218' are provided in each plate 208' and six impactor bars 90' are used. Each bar 90' is of similar form to the bars 90 of the previous views.

In both embodiments the impactor core is solid. As a result, the impactor acts in the manner of a flywheel in use. This has the advantages that, the power required to maintain rotation of the impactor during crushing and the magnitude of potentially damaging impact forces acting on the impactor shaft and drive components are minimized.

Figure 9:
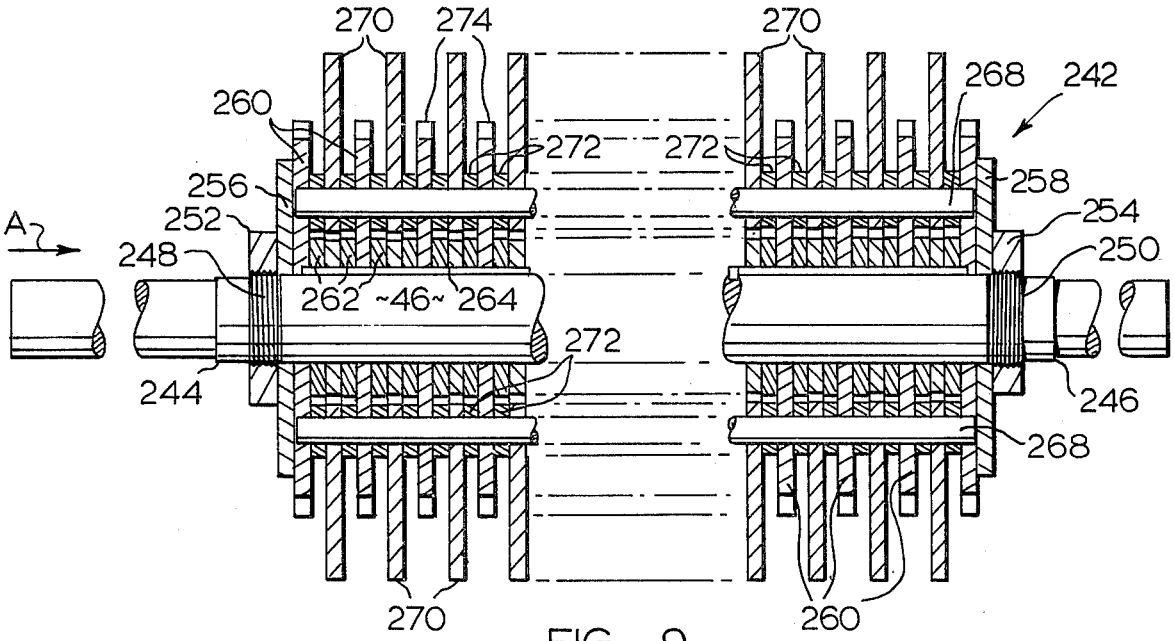
FIG. 9 is a longitudinal vertical sectional view through the hammer mill of the crusher of FIG. 1; and, FIG. 10 is a view similar to FIG. 9 and shows an alternative form of hammer mill.
Figure 10:
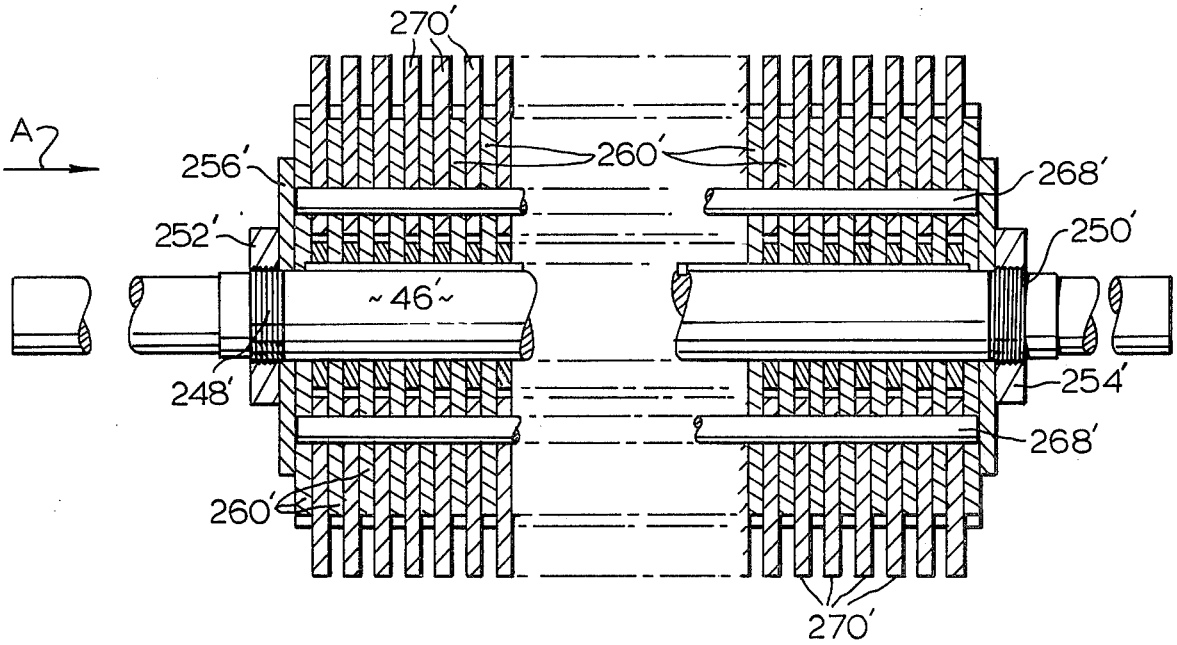

Reference will now be made to FIGS. 9 and 10 in describing the construction of the hammer mill 44. FIG. 9 is a vertical cross-sectional view through the mill 44 of FIGS. 2 and 3 and FIG. 10 is a similar view through a modified hammer mill.

Referring first to FIG. 9, the hammer mill 44 includes a rotor 242 of laminated construction mounted on the drive shaft 46. Drive shaft 46 is shouldered at 244, 246 adjacent respectively opposite ends of the rotor 242. Inwardly of the shoulders 244, 246, shaft 46 is provided with two screw threaded sections 248, 250 which respectively receive nuts 252, 254. The section 248 shown at the left hand side in FIG. 9 is formed with a right hand screw thread and the section 250 at the other end of shaft 46 is formed with a left hand thread. The direction of rotation of the hammer mill is clockwise viewed in the direction of arrow A in FIG. 9.

The rotor includes two end plates 256, 258 positioned inwardly of and adjacent the respective nuts 252, 254. A series of generally star-shaped plates 260 are spaced along the rotor between the end plates. The shape of the plates 260 is visible in FIGS. 2 and 3. Adjacent plates in the core 242 are spaced by annular spacing members 262 (FIG. 9) and alternate plates are angularly offset with respect to one another by 45° as also can be seen from FIG. 2. The plates 260 are keyed to the drive shaft 46 by means of a key 264. The plates 260 are all identical but alternate plates are reversed compared with the intervening plates. The cutouts to receive the key 264 are specially positioned so that this reversal of alternate plates produces the offset arrangement mentioned above. As has been previously mentioned, each of the plates 260 is generally star-shaped. Accordingly, each plate defines four outwardly projecting limbs 266 disposed mutually at right angles. By virtue of the angularly offset relationship of alternate ones of said plates 260, the limbs 266 of such alternate plates are aligned longitudinally of the hammer mill. Accordingly, the hammer mill includes eight sets of aligned limbs as can be seen from FIG. 2. Associated with each of these sets of limbs is a circular section shaft 268 which extends parallel to the axis of shaft 46 through the said limbs. Two of such shafts are visible in FIG. 9. Each shaft carries a series of hammers 270. Each hammer is of elongate form and has an enlarged inner end formed with a circular opening which receives the relevant one of said shafts 268. Each hammer is located longitudinally of the shaft on which it is mounted by two bushes 272 positioned one on each side of the hammer.

It will be appreciated that, because of the angularly offset relationship of alternate ones of the plates 260, each plate 260 which is visible in FIG. 9 lies in the same plane as four hammers carried by an adjacent plate 260. The outer ends of two of these hammers are visible in FIG. 9 and are indicated by the reference numeral 274. Similarly, each hammer which is visible in FIG. 9 lies in the same plane as one of the plates 260. The central portions of such plates are visible in cross-section adjacent the shaft 46.

By virtue of the hammer mill construction described above, the hammers 270 are freely pivotable on the shafts 268 on which they are mounted and can swing against rock and like material in their paths when the hammer mill is in use. Due to centrifugal force, the hammers 270 will be normally flung outwardly into the radial positions in which they are shown in FIGS. 2 and 3 when the hammer mill is in operation.

FIG. 10 shows a modification of the hammer mill shown in FIG. 9. Primed reference numerals have been used in FIG. 10 to denote parts which correspond with FIG. 9. Basically, the hammer mill shown in FIG. 10 is similar to that of FIG. 9 except that the spacer members 262 on shaft 46 and the spacing bushes 272 on opposite sides of the hammers 270 have been omitted. Accordingly, for a given length of hammer rotor, the structure of FIG. 10 carries more hammers than the FIG. 9 structure.

It will be appreciated that a primary advantage of the crusher described above is its versatility. The crusher can operate with a wide range of different input materials, whether wet or dry. It is believed that in practice the present crusher will replace the range of different crushers which has been previously required for the recovery and processing of minerals. In other words, it is believed that the present crusher will be adequate by itself. Hopefully, this will lead to a situation in which small scale recovery and processing of minerals becomes economic.

A further significant advantage of the present crusher is that of portability. The crusher design shown in the drawings is primarily intended for a relatively small crusher which will be readily transportable, although there is of course no limitation to size within the broad scope of invention. By way of example, the impactor rotor may be approximately 24 inches square by 32 inches long. Similarly, the hammer mill rotor may be approximately 11 inches in diameter and 32 inches long. The casing of the crusher may have the following approximate dimensions: length 78 inches; width 12 inches; heighth 76 inches.

It should finally be noted that the preceding description applies to specific embodiments of the invention and that numerous variations are possible within its broad scope. For example, the impactor and hammer mill need not essentially be of the specific forms shown in the drawings. Such variations will be readily apparent to a person skilled in the art.

With respect to the crusher drive source, the crusher is described above as being driven by an electric motor. In an alternative arrangement, a diesel or other internal combustion engine could be used and may be supported separately from the crusher as described in connection with the electric drive. A further alternative drive source is a conventional hydraulic pulley drive mounted directly on the impactor drive shaft. Such an arrangement may provide certain advantages over electric or internal combustion engine drive in eliminating the need for auxiliary equipment such as a special support structure, rheostat (in the case of an electric drive motor) and clutch (in the case of the internal combustion engine).

Examples of materials which may be crushed in the apparatus of the invention are:

Wet mode: galane, antimony, tungsten.

Dry mode: zinc.

What we claim is:

1. Apparatus for crushing rock, stone and like material, the apparatus being operable selectively in a mode for crushing dry material or in a mode for crushing wet material, and the apparatus comprising:

a casing defining:

a. a primary crushing chamber having an inlet to receive material to be crushed, and first and second outlets, said first outlet being adapted to receive first screening means for controlling the size of material delivered through said first outlet when the apparatus is operating in said dry mode, and said first outlet being adapted to be closed when the apparatus is operating in said wet mode, said second outlet opening to the exterior of the casing and being adapted to be closed when the apparatus is operating in said dry mode;

b. a secondary crushing chamber having an inlet and first and second outlets, said second outlet opening to the exterior of the casing and being adapted to be closed when the apparatus is operating in said dry mode; and, c. a passageway disposed above said secondary crushing chamber, said passageway communicating with said first outlet of said primary crushing chamber and with said inlet and first outlet of said secondary crushing chamber, said passageway defining an opening to the exterior of the casing and being adapted to receive, adjacent said opening, second screening means for controlling the size of material delivered outwardly through said opening when the apparatus is operating in said dry mode;

a rotary impactor mounted for rotation in said primary crushing chamber;

means for adjusting the position of said impactor in said primary crushing chamber between a first position in said dry mode of operation of the apparatus and a second position in said wet mode of operation of the apparatus; and, a rotary hammer mill mounted for rotation in said secondary crushing chamber.

2. Apparatus as claimed in claim 1, wherein the said rotary impactor comprises a rotor including a drive shaft disposed in said primary crushing chamber and having ends projecting through the ends of said chamber; a rotor core secured to said drive shaft in said primary crushing chamber for rotation with said shaft; and a plurality of fixed hammers coupled to said rotor core and projecting from said core for action on material in said primary crushing chamber; and wherein the apparatus further comprises: bearings rotatably supporting said projecting ends of the impactor drive shaft, said bearings being located externally of the primary crushing chamber; and wherein said means for adjusting the position of the impactor are coupled to said bearings for displacing the bearings in a direction normal to the axis of rotation of the impactor drive shaft so as to move the rotor between said first and second positions.

3. Apparatus as claimed in claim 2, further comprising: brackets coupled to said casing of the apparatus and supporting said bearings; and means for releasably securing the bearings to said brackets to locate the impactor in one of said first and second positions; and wherein said adjusting means include, in association with each of said bearings, a fluid-pressure operated piston and cylinder unit adapted to lift the bearing with respect to said bracket when said securing means are released; and means for displacing the bearing with respect to said bracket.

4. Apparatus as claimed in claim 3, wherein each of said piston and cylinder units is slidably mounted on a support shaft extending parallel to the direction in which the impactor is adjusted and is displaced along said shaft by said displacing means.

5. Apparatus as claimed in claim 2, wherein the said rotor core is of laminated form, comprising an assembly of a plurality of similar plates formed with recesses defining slots extending parallel to said drive shaft, and wherein each of said hammers is of elongate form and is dimensioned to slidably fit into one of said slots, each hammer defining an impact face adjacent said laminated core.

6. Apparatus as claimed in claim 5, wherein each of said hammers is shaped to define alternative, oppositely-directed impact faces and is designed to be fitted to said rotor core in one of two positions, in each of which one of said faces is exposed for action on material in said primary crushing chamber, whereby each said hammer is reversible in the event that the first impact face becomes excessively worn.

7. An apparatus as claimed in claim 1, wherein at least part of the casing defining said primary crushing chamber includes a plurality of removable casing sections, each section being provided on its inner surface with a series of angled impactor breakers against which material in said primary crushing chamber is thrown by the rotary action of the impactor in use.

8. Apparatus as claimed in claim 1, wherein said hammer mill includes a drive shaft; a rotor core; and a plurality of elongate hammers, each hammer having an inner end pivotally coupled to the core for free swinging movement about an axis parallel to said hammer mill drive shaft.

9. Apparatus as claimed in claim 8, wherein said rotor core is of laminated construction comprising an assembly of similar, generally star-shaped rotor plates, each plate defining four limbs disposed mutually at right angles, and alternate plates in said assembly being offset by 45° with respect to one another, whereby said limbs define eight sets of limbs aligned longitudinally of the hammer mill; and wherein a pivot shaft is coupled to said limbs in each of said sets, each said shaft extending parallel to the hammer mill drive shaft and the inner ends of the hammers being mounted for free swinging movement on said shafts.

10. Apparatus as claimed in claim 1, wherein each of said first and second screening means includes two perforated screens arranged in sliding surface contact, and means for adjusting the screens relative to one another so as to vary the degree of coincidence of the perforations in the respective screens.

11. Apparatus as claimed in claim 1, further comprising a funnel-shaped outlet coupled to the casing of the apparatus at the position of said passageway opening, said outlet tapering in a direction away from said opening.

12. Apparatus as claimed in claim 1, wherein the apparatus is portable and includes a pair of ground-engaging skids on which the casing of the apparatus is supported, whereby the apparatus may be transported by towing on said skids.

13. Apparatus for crushing rock, stone and like material, the apparatus comprising:

a casing defining a crushing chamber having an inlet to receive material to be crushed, and at least one outlet;

a rotary impactor mounted for rotation in said crushing chamber, said impactor comprising a rotor which includes: a drive shaft mounted in said crushing chamber for rotation about an axis; a solid rotor core secured to said drive shaft in said crushing chamber for rotation with said shaft, said rotor core defining a plurality of slots disposed generally parallel to said drive shaft axis, and a corresponding plurality of planar faces extending between said slots and together defining the general shape of a regular straight sided polygon as viewed on a sectional plane through the rotor core normal to said axis; and a plurality of elongate hammers each received in one of said slots in the rotor core and projecting from said core for action on material in said crushing chamber; each hammer being of uniform cross-section throughout its length and having an enlarged inner portion which is received in a complementarily shaped enlarged inner portion of the slot so that each hammer is normally positively retained against movement radially outwardly of the rotor core but can be slid longitudinally out of said slot for maintenance of the apparatus; and means for driving said drive shaft in rotation.

14. Apparatus as claimed in claim 13, wherein said rotor core is of laminated form, comprising an assembly of a plurality of similar plates formed with recesses defining said slots.

15. Apparatus as claimed in claim 13, wherein each of said hammers is shaped to define alternative, oppositely-directed impact faces, and wherein said enlarged inner portion is of a shape which is symmetrical about a longitudinal median plane of the hammer so that the hammer can be fitted to said rotor core in one of two positions, in each of which one of said faces is exposed for action on material in said crushing chamber, whereby each said hammer is reversible in the event that the first impact face becomes excessively worn.

16. A rotary impactor for use in an apparatus for crushing rock, stone and like material having a crushing chamber, the impactor comprising a rotor which includes: a drive shaft adapted to be mounted in said crushing chamber for rotation about an axis; a solid rotor core secured to said drive shaft for rotation with said shaft, said rotor core defining a plurality of slots disposed generally parallel to said drive shaft axis, and a corresponding plurality of planar faces extending between said slots and together defining the general shape of a regular straight sided polygon as viewed on a sectional plane through the rotor core normal to said axis; and a plurality of elongate hammers each received in one of said slots in the rotor core and projecting from said core for action on material in said crushing chamber in use; each hammer being of uniform cross-section throughout its length and having an enlarged inner portion which is received in a complementarily shaped enlarged inner portion of the slot so that each hammer is normally positively retained against movement radially outwardly of the rotor core but can be slid longitudinally out of said slot for maintenance of the apparatus; and, means for driving said drive shaft in rotation.

17. Apparatus for crushing rock, stone and like material, the apparatus comprising:

a casing defining a crushing chamber of generally cylindrical form extending about a longitudinal axis and having an inlet to receive material to be crushed, at least one outlet spaced from said inlet angularly about said axis of the chamber, and an impact surface disposed between said inlet and outlet, said surface extending axially of the crushing chamber and being, throughout its extent, of constant cross-sectional shape with respect to said longitudinal axis of the crushing chamber;

a rotary impactor mounted for rotation in said crushing chamber about a longitudinal axis parallel to said axis of the crushing chamber, said impactor being of a length generally co-extensive with said impact surface and of constant cross-sectional shape throughout its length so as to define, with said impact surface, an impact zone which extends in a direction parallel to said axis of the crushing chamber and is of uniform cross-sectional shape throughout its length; and, means for adjustng the position of said impactor in said crushing chamber whilst maintaining said axis of the impactor parallel to said longitudinal axis of the crushing chamber, to vary the proximity of the impactor to said impact surface of the crushing chamber.

* * * * *